US008512074B2

(12) United States Patent
Frey

(10) Patent No.: US 8,512,074 B2
(45) Date of Patent: Aug. 20, 2013

(54) APPARATUS AND METHODS OF SEALING AND FASTENING POTHEAD TO POWER CABLE

(75) Inventor: Jeffrey G. Frey, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 112 days.

(21) Appl. No.: 13/247,196

(22) Filed: Sep. 28, 2011

(65) Prior Publication Data

US 2012/0100737 A1 Apr. 26, 2012

Related U.S. Application Data

(60) Provisional application No. 61/405,875, filed on Oct. 22, 2010.

(51) Int. Cl.
*H01R 13/40* (2006.01)

(52) U.S. Cl.
USPC ..... 439/589; 439/279

(58) Field of Classification Search
USPC ..... 439/274, 275, 279, 587, 589
See application file for complete search history.

(56) References Cited

U.S. PATENT DOCUMENTS

| | | | | |
|---|---|---|---|---|
| 5,286,220 | A | 2/1994 | Watson | |
| 5,567,170 | A | 10/1996 | Kroeber | |
| 6,361,342 | B1 | 3/2002 | Cox | |
| 6,676,447 | B1 | 1/2004 | Knox | |
| 7,101,217 | B2 * | 9/2006 | Hayashi | 439/447 |
| 7,207,840 | B2 * | 4/2007 | Fukushima et al. | 439/589 |
| 7,942,696 | B2 | 5/2011 | Watson | |
| 2009/0269956 | A1 | 10/2009 | Frey et al. | |
| 2010/0167582 | A1 | 7/2010 | Watson | |

* cited by examiner

*Primary Examiner* — Khiem Nguyen
(74) *Attorney, Agent, or Firm* — Bracewell & Giuliani LLP

(57) ABSTRACT

Apparatus of components and methods for connecting and sealing a pothead to an electrical cable used in an oil well environment, are provided. Electrical leads are anchored in insulating members retained within the pothead. The leads inserted into passages formed through the insulating members each having an elliptically shaped portion. Channels are formed along the surface of the passages and along the circumference of the elliptically shaped portions. Boot seals are provided in the elliptically shaped portions and circumscribe the electrical leads. A hydrocarbon-based liquid is applied to the boot seals to cause them to swell and occupy the space between the leads and the insulators, including the channels.

18 Claims, 4 Drawing Sheets

APPARATUS AND METHODS OF SEALING AND FASTENING POTHEAD TO POWER CABLE

RELATED APPLICATIONS

This patent application is a non-provisional of and claims priority to and the benefit of U.S. Provisional Patent Application No. 61/405,875 filed on Oct. 22, 2010, incorporated by reference in its entirety.

BACKGROUND OF THE INVENTION

1. Field of the Invention

This invention relates to methods and apparatus for coupling an electrical cable to an electrical submersible pump electric motor.

2. Description of the Related Art

A pothead describes in general a device that couples an electrical cable to an electrical submersible pump (ESP) electrical motor. There are many conventional methods to achieve such coupling. Such conventional methods require a seal to be made between the pothead and electrical cable by according to two primary methodologies.

In the first methodology, a pothead connection assembly or matching mold is assembled with uncured rubber, which is then baked in the assembly for a length of time so the rubber will cure. In this process, the rubber will fill all of the voids and will set. As there is no free space left within the pothead assembly, during operation at elevated temperatures, there will not be sufficient room for thermal expansion of the rubber. As such, the rubber may exert excessive stress on the cable insulation and pothead internal components, thus limiting the maximum operation temperature to approximately 375° F. depending upon the type of material used.

In the second methodology, an axial, compressive force is applied to an elastic/pliable material (rubber, plastics, polyimide etc.) by a pair of oppositely positioned insulators, which distributes the force radially, similar in function to a compression fitting. According to this methodology, a seal is preloaded in a fixed volumetric space. Thus, when the temperature around the seal increases, it has no relief from the thermal expansion—again limiting the maximum operation temperature.

In a third methodology, longitudinally extending springs have been employed to try to limit the amount of excessive compressive force being applied as a result of thermal expansion. According to such methodology, when the compressive force becomes excessive, the longitudinally extending springs are compressed to allow the oppositely positioned insulators to separate. Nevertheless, besides the added complexity, forces may still be applied radially to the cable insulation prior to the rubber expanding longitudinally.

Further, each of the above methodologies are still affected by swelling of the rubber due to exposure to a dielectric oil, e.g., mineral oil, from the motor and/or hydrocarbons from within the well.

Recognized, therefore, by the inventor is the need for a pothead connector, boot seal assembly, and boot seal which can provide a seal upon installation and at lower temperatures, that also accounts for both thermal expansion and expansion due to contamination with motor oil and production fluid.

SUMMARY OF THE INVENTION

Various embodiments of the present invention can solve the aforementioned problems. Various embodiments of the present invention advantageously provide a method and pothead assembly for forming a seal around each one of a set of conductors extending down a well bore and into a motor housing of an electrical submersible pump. According to various embodiments of the present invention, pre-cured elastomeric boot seals are utilized to form a seal between the pothead components and the insulation of an electrical cable or other conductor. Dielectric oil can be used as a catalyst with the elastomeric boot seals, to cause the boots to swell into grooves in a portion of the insulator or insulators adjacent the elastomeric boot seals located inside the pothead assembly. The swollen elastomeric boot seals can securely fasten the boots and cable to the pothead assembly, while adding a pressure differential seal. Grooves in the portion of the insulator or insulators adjacent the elastomeric boot seals can allow for thermal expansion of the rubber seal, as well. As such, this configuration can advantageously impede pressure build up from the thermal growth of the rubber and growth due to oil-based contaminants while adding integrity to the locking and sealing mechanism of the boots at operating conditions. Advantageously, various embodiments result in an increase in the maximum continuous downhole operating temperature limitation of approximately 50° F. or more.

An example of an embodiment of a method of forming a seal around at least one conductor extending through a pothead connector to be connected to a motor of an electrical submersible pump includes the steps of impregnating a boot seal with a catalyst to pre-expand a volumetric size of the boot seal. The boot seal has or contains a bore for receiving a conductor and is configured to sealingly engage inner surface portions thereof with outer surface portions of the conductor. The method also includes inserting the boot seal into at least a portion of a boot seal cavity located within a first insulator before extensive volumetric expansion of the boot seal occurs. The exemplary method also includes inserting the first insulator into a pothead assembly cavity within a housing of the pothead connector, and enclosing the boot seal in the boot seal cavity with a second insulator. The second insulator registers with the first insulator and is also positioned within the pothead assembly cavity within the housing.

Volumetric expansion initiated upon pre-impregnation with the catalyst continues within the boot seal cavity after insertion therein and further occurs after pre-deployment contamination with motor fluid and upon contact with well fluids and when exposed to environmental temperatures in an operating environment. As such, the boot seal cavity is sized to accommodate a post-expansion volume of the boot seal. Additionally, the step of inserting the boot seal into the boot seal cavity is normally performed prior to the boot seal swelling beyond approximately an internal diameter of either of a plurality of integral annular boot seal retaining and support rings positioned within a medial portion of the boot seal cavity, otherwise the boot seal will likely be damaged during the insertion process and will need to be discarded.

An example of an embodiment of a pothead connector apparatus for forming a seal around at least one conductor to be connected to a motor of an electrical submersible pump, includes a housing having a pothead assembly cavity and a pothead assembly contained within the housing. The pothead assembly includes a first insulator having first bore extending therethrough having a generally cylindrical shaped portion and a generally conical shaped portion adjacent thereto. The assembly also includes a second insulator having a second bore extending therethrough. The second insulator has a generally cylindrical portion and a generally conical shaped proximal portion adjacent thereto. The conical shaped portion of the second bore registers with the cylindrical shaped portion of the first bore to define a boot seal cavity. A boot seal for receiving a conductor is positioned within the boot seal cavity. The boot seal includes a substantially cylindrical shaped medial outer surface portion, a tapered proximal outer surface portion, a tapered distal outer surface portion, and a through-bore sized to sealingly engage inner surface portions of the boot seal with outer surface portions of the conductor and to sealingly engage with inner surface portions of the first and the second insulators forming the boot seal cavity.

According to the exemplary configuration, the conical shaped portion of the first insulator includes a conical shaped medial portion contained within the confines of the body of the first insulator. The first insulator similarly has a conical shaped proximal portion adjacent to the conical shaped medial portion and extending through a proximal face of the first insulator. The cylindrical shaped portion of the first insulator includes a plurality of integral annular boot seal retaining and support rings extending into the first bore to provide sufficient support to the boot seal during low-temperature operations in which the boot seal has not expanded into a portion of a volume of the boot seal cavity between adjacent rings of the plurality of annular rings. Correspondingly, the boot seal cavity includes a plurality of annular recesses each surrounding or interleaved with one or more of the plurality of annular boot seal retaining and support rings. According to a preferred configuration, a volume of the boot seal cavity between outer surface portions of the conductor an inner surfaces of the first and second bores defining the boot seal cavity is a fixed volume. As such, the volume of the boot seal cavity exceeds at least approximately 20% of a volume of the boot seal contained within the boot seal cavity to provide for thermal and contaminant-based expansion of the boot seal.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

According to various embodiments of the present invention, pre-cured elastomeric boot seals are utilized to form a seal between the pothead components and the insulation of an electrical cable or other conductor. Dielectric oil can be used as a catalyst with the elastomeric boot seals, to cause the boots to swell into grooves in a portion of the insulator or insulators adjacent the elastomeric boot seals located inside the pothead assembly. The swollen elastomeric boot seals can securely fasten the boots and cable to the pothead assembly, while adding a pressure differential seal. Grooves in the portion of the insulator or insulators adjacent the elastomeric boot seals can allow for thermal expansion of the rubber seal, as well. As such, this configuration can advantageously impede pressure build up from the thermal growth of the rubber and growth due to oil-based contaminants while adding integrity to the locking and sealing mechanism of the boots at operating conditions. A more detailed discussion is provided below.

Figure 1:
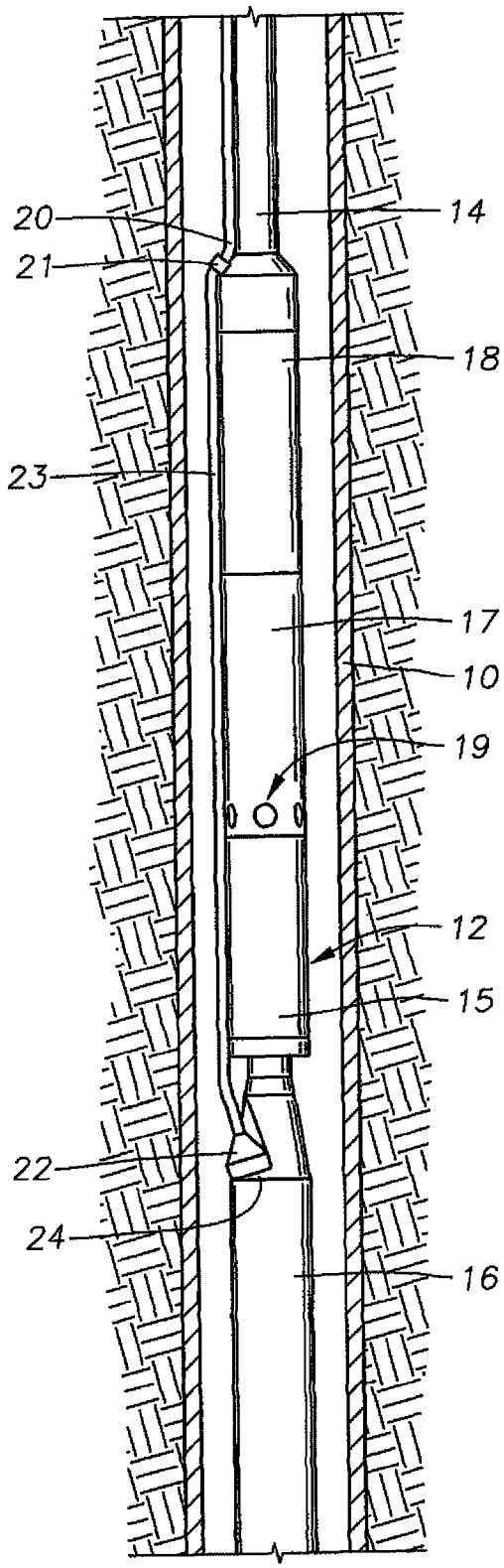
FIG. 1 is an environmental view of an electrical submersible pump disposed in a well bore according to an embodiment of the present invention.

FIG. 1 is an elevational section view of well bore 10 having electrical submersible pumping system (ESP) 12 disposed therein. ESP 12 includes an electric motor 16, a seal/equalizer section 15, an optional separator 17, and a pump 18. Pump 18 may comprise a centrifugal pump or a progressing cavity pump, for example. Fluid inlets 19 are shown provided on separator 17 for providing a passage for receiving fluid into ESP 12. Production tubing 14 is coupled to pump 18 discharge for conveying pressurized production fluid from the ESP 12 to surface. Cable 20 extends downhole, terminating in a connector 21 that electrically couples cable 20 to a motor lead 23. Motor lead 23, on its lower terminal end, connects to a pothead connector 22 that electrically connects and secures motor lead 23 to motor housing 24 of electric motor 16. In another embodiment, cable 20 can extend all the way from the surface to pothead connector 22, thereby eliminating the need for connector 21.

Figure 2:
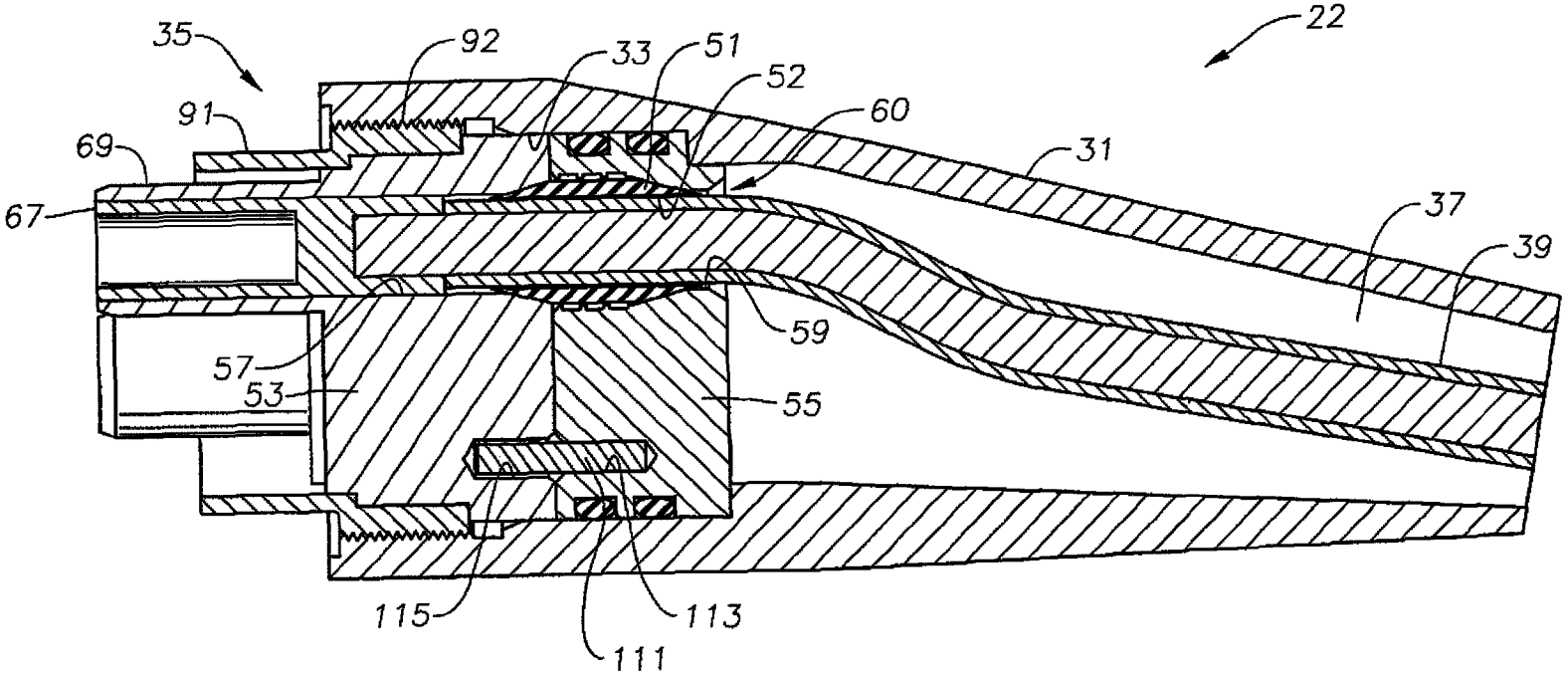
FIG. 2 is cross-sectional view of a pothead assembly according to an embodiment of the present invention.
Figure 3:
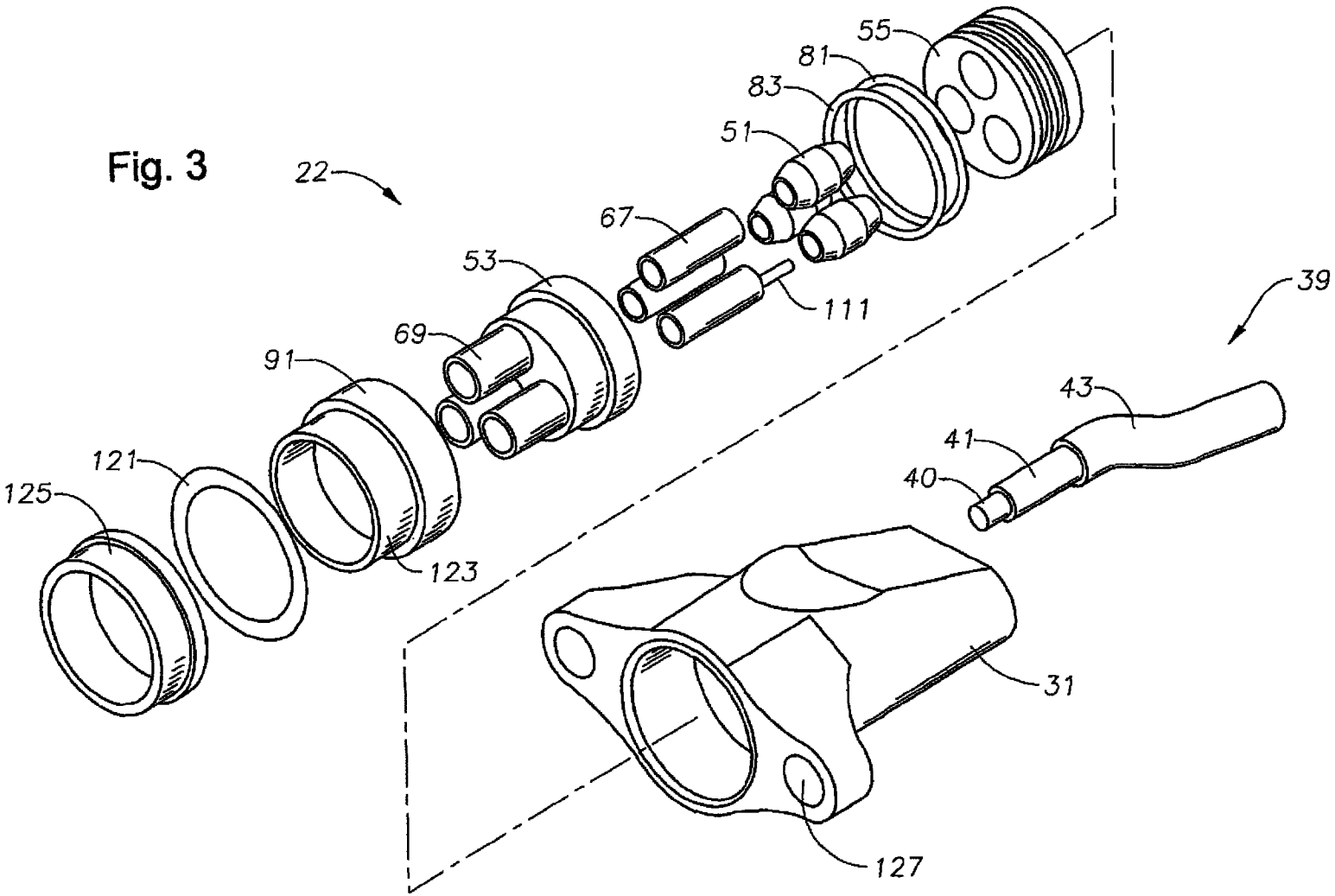
FIG. 3 is an exploded perspective view of a pothead assembly according to an embodiment of the present invention.

FIG. 2 is a longitudinal cross sectional view depicting an embodiment of pothead connector 22 and FIG. 3 is an exploded view in accordance with an exemplary embodiment of the pothead connector 22. In the embodiment shown, pothead connector 22 comprises a housing 31 adapted to connect the pothead connector 22 to the motor housing 24. As shown, formed into an end of the pothead housing 31 is a cylindrical cavity 33 for containing a compression seal assembly 35 One or more passageways/conduits 37 extend from an opposite end of the pothead housing 31 and into the cavity 33. The conduits 37 receive a plurality of electrical conductors 39, one for each phase of the motor 16. For clarity, it should be noted that FIGS. 2 and 3 reflect a single electrical conductor 39. The typical motor 16 for an ESP 12 is a three-phase motor having three conductors 39.

As shown in FIG. 3, each conductor 39 provides an electrical pathway from surface equipment (not shown) to the electric motor 16 and includes a wire 40 separately insulated by its own insulating layer 41. A protective barrier of thin-walled tubing 43 surrounds each insulating layer 41 and functions to protect the insulating layer 41 and wire 40 from harsh elements within well bore 10. In an embodiment of the present invention, the insulating layer 41 and tubing 43 are sized to allow a gap (not shown) between the inner diameter of the tubing 43 in the outer diameter of the insulating layer 41 to form an annulus (not shown) to allow for circulation of dielectric fluids (not shown). The dielectric fluids, when utilized, can provide additional insulation protection to each wire 40 as well as alleviate all air voids.

Figure 4:
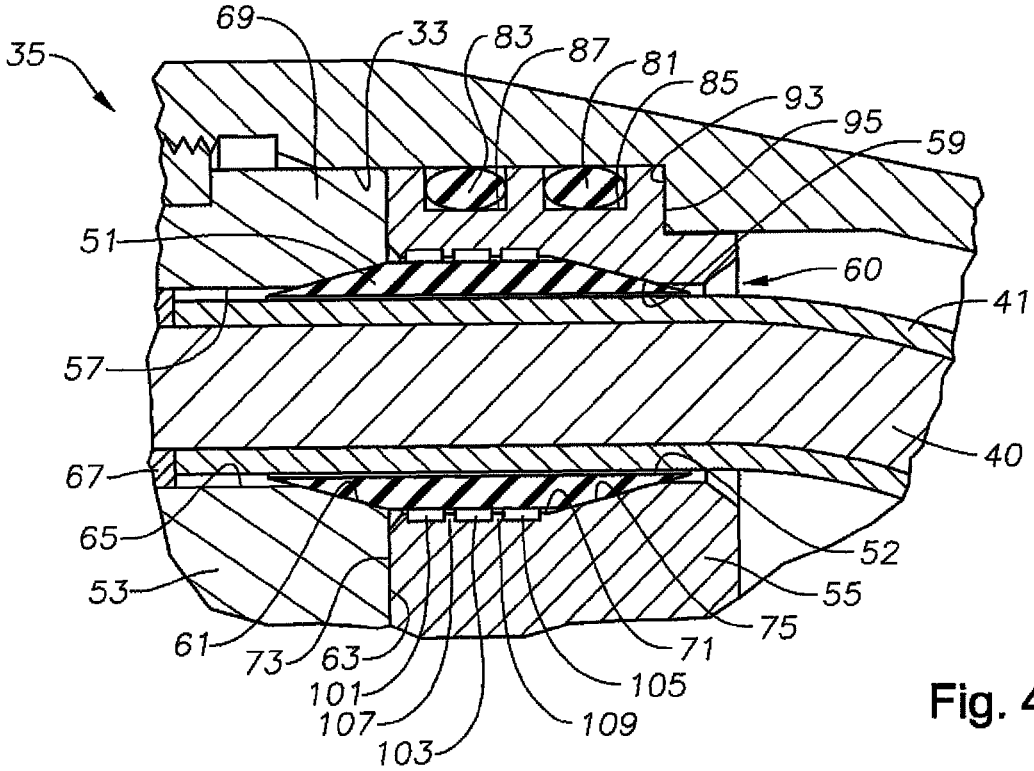
FIG. 4 is a cross-sectional view of boot seals of a pothead assembly prior to pre-impregnation with oil according to an embodiment of the present invention.

As shown in FIG. 4, compression seal assembly 35 includes elastomeric boot seals 51 for sealing along an interface between the conductors 39 and the body of the connectors 22. Each boot seal 51 is typically constructed of an elastomer such as ethylene propylene diene monomer (M-class) rubber but can include other similar materials known to one of ordinary skill in the art, including ALFAS (fluorinated polymer), PTFE, fluoroelastomer, nitrile butadiene (NBR), HNBR. Each boot seal 51 includes a through bore 52 dimensioned to sealingly accommodate the insulating layer 41 therethrough. Optionally, the bore 52 can be sized for sealing engagement with the outer circumference of the wire 40 or tubing 43. By sealingly engaging the outer surface of one of the conductors 39, a fluid barrier is provided to prevent the ingress of well fluid into the motor 16 and to prevent loss of motor oil into the well bore 10 during operational employment of the ESP 12. According to the configuration as shown in FIG. 4, the boot seal 51 is in the shape of double sided ferrel or prolate spheroid (football) to enhance bidirectional sealing.

Referring now to FIG. 2, the compression seal assembly 35 also includes a pair of lower and upper insulators 53, 55 positioned to compressively house and contain the boot seals 51. According to the illustrated configuration, lower and upper insulators 53, 55 each have generally cylindrical portions and are set generally coaxial within the connector 22. Bores 57 in the lower insulator 53 register with bores 59 in the upper insulator 55 to define cavities 60. As shown in FIGS. 2 and 4, the boot seals 51 are disposed in the annular space between the conductors 39 and walls of the cavities 60. As shown in FIG. 4, each bore 57 of lower insulator 53 can include a conically shaped bore section 61 extending longitudinally from the "upper" face 63 of the lower insulator 53, configured to house a portion of one of the boot seals 51. Each bore 57 further includes a cylindrical shaped bore section 65 for receiving a corresponding female conductor terminal pin 67 positioned to connect the motor 16 to the wires 40. In the example configuration illustrated in FIG. 2, each cylindrical shaped bore section 65 extends through an annular extension 69 housing a substantial portion of the respective female conductor terminal pin 67. The extension 69 projects from an end of the lower insulator 53 opposite the upper insulator 55 in a direction substantially parallel with an axis of the lower insulator 53.

Referring now to FIG. 4, each bore 59 of upper insulator 55 can include a combination of a cylindrical shaped bore section 71 extending longitudinally from the "lower" face 73 of the upper insulator 55 and a conically shaped bore section 75 extending longitudinally from the upper confines of the cylindrically shaped bore 71 to house remaining portions of a respective one of the boot seals 51. Note, although other configurations are within the scope of the present invention, in an example embodiment, about seventy to seventy-five percent of each boot seal 51 is contained within upper insulator 55 with the other twenty-five to thirty percent being contained within lower insulator 53. Beneficially, the extension of the boot seals 51 across the interface between the upper face 63 of lower insulator 53 and the lower face 73 of upper insulator 55 can help prevent fluid incursions between the faces 63, 65. In the illustrated configuration, the slope of the conically shaped bore sections 61, 75 of the lower and upper insulators 53, 55, and thus, the lower and upper portions of the boot seal 51 is between approximately 10°-20°, and more typically approximately 15°. Further, the cylindrical shaped bore section 71 and corresponding section off boot seal 51 is typically between approximately 0.15"-0.23", and more typically 0.183" in longitudinal length with sections 61, 75 being between approximately 0.180"-0.240" and more typically 0.220" in length, respectively. In a typical implementation, there are a limited number of sizes of conductors 39 for any ESP implementation. Accordingly, for such implementation, the inner diameter of bore 52 of each boot seal 51 also comes in a set of generally standard sizes. For standard ESP conductors, the inner diameter is typically approximately 0.320"-0.327" and more typically 0.322" for the typical larger conductor; typically approximately 0.298"-0.305" and more typically 0.300" for the typical larger conductor; and typically approximately 0.280"-0.287" and more typically 0.282" for the typical small conductor.

According to the illustrated embodiment, upper insulator 55 includes a pair of seals 81, 83, with "upper" seal 81 being primary and "lower" seal 83 being secondary. In an example embodiment, seals 81, 83 can be elastomeric O-rings which land within the corresponding annular recesses 85, 87 extending along an outer diameter of upper insulator 55 to provide a seal between outer surfaces of upper insulator 55 and inner diameter surfaces of the housing 31 within cavity 33. An annular retaining nut 91 is threaded on an outer surface, threadingly connecting the nut 91 to corresponding threads 92 formed on an inner circumference of the cavity 33 urges an end of the nut 91 against a ledge shown radially protruding from an outer surface of the lower insulator 53. Continued threaded engagement between the nut 91 and threads 92 to urge the nut 91 against the ledge in turn urges the lower and upper insulators 53, 55 into the cavity 33 to retain the lower and upper insulators 53, 55, and thus, sealingly retain boot seals 51. An annular shoulder 93 in the housing 31 contacts an upper surface 95 of upper insulator 55 and stops urging of the lower and upper insulators 53, 55 into the cavity 33.

Beneficially, according to an example embodiment of the present invention, outer diameter surfaces of cylindrically shaped bore 71 include an annular recess formed along its entire periphery. In an optional embodiment, a plurality of annular recesses 101, 103, 105 are provided in the surface of the cylindrically shaped bore 71. In the example embodiment of FIG. 4, the annular recesses 101, 103, 105 form a plurality of integral boot seal retaining/support rings 107, 109. In the exemplary configuration, each cavity 60 containing a boot seal 51 has a fixed volumetric space comprising the volume formed by a conically shaped bore sections 61, 73, the cylindrical shaped bore section 71, and recesses 101, 103, 105. This provides cavities 60 with a volume of approximately 0.024354 in.$^3$ for a standard size conductor 39, of which approximately 0.003978 in.$^3$ is provided by recesses 101, 103, 105. Also according to the exemplary configuration, the volume of cavities 60 is approximately 20% greater than the volume of the associated portions of the boot seals 51, e.g., 0.20376 in.$^3$, that would fill the cavities 60 prior to pre-impregnation and/or operational impregnation with a dielectric fluid (described below).

In the exemplary configuration, insulators 53, 55 do not include a spring or other means for longitudinally expanding the size of cavity 60 after installation, for example, due to contamination of the boot seals 51 with motor oil or well fluids or due to increased heat associated with the well bore 10 and/or operation of the motor 16. But rather, through the provision of the plurality of annular recesses 101, 103, 105 surrounding the cavity 60 in conjunction with a pre-impregnation of each boot seals 51 with the dielectric oil (described below), and in combination with precise sizing of each cavity 60 in relation to the volume of boot seals 51, various embodiment of the present invention are able to achieve an operational temperature rating at or in excess of 425° F. (e.g., 19° F. to 425° F.). Beneficially, such rating can be accomplished without resorting to the complication of utilization of cavity size adjustment/insulator separation systems, particularly longitudinal based systems that separate upper and lower insulators.

Further, beneficially, as illustrated, the recesses 101, 103, 105 and retaining/support rings 107, 109 are typically spaced around a middle of each respective boot seal 51, and positioned to provide sufficient structural support to the medial section of the boot seal 51 when the boot seal 51 does not "fully" fill cavity 60 such as, for example, operation at lower temperatures and/or before extensive well fluid contact. The desired volume of cavity 60 in relation to the volume of e.g. rubber or other sealing material forming the boot seals 51, are determined based on empirical data describing an amount of swelling to be expected from the boot seals 51 due to dielectric fluid pre-impregnation and motor oil contamination, and an amount of swelling or contraction to be expected from a contaminated boot seal resulting from motor operation and wellbore conditions during operational employment.

In an example of operation, prior to deployment of the ESP 12 in the well bore 10, pothead connector 22 is assembled and connected to motor housing 24 of electric motor 16. In an exemplary assembly process, wires 40 of conductors 39 are extended through the cavity 33 of the housing 31 and through bores 59 of the upper insulator 55, and wires 40 are connected to female terminal pins 67. Primary and secondary seal rings 81, 83 are positioned in annular recesses 85, 87 of upper insulator 55, and the upper insulator 55 is inserted into cavity 33 of the housing 31 until upper surface 95 of the upper insulator 55 contacts shoulder 93 of the housing 31. An annular shoulder 93 in the housing 31 adjacent the upper surface 95 of upper insulator 55 functions as a stop for upper insulator 55 when inserted within housing 31.

Boot seals 51 are then inserted into cavity 59 of the upper insulator 55. Prior to insertion, inner and outer surfaces of the boot seals 51 are pre-impregnated with a thin film of a petroleum-based nonconductive dielectric liquid such as polyalphaolefin or similar lubricating and swelling fluids, for example. This can be accomplished with use of an eyedropper (not shown), for example. In an exemplary installation process, two or three drops of oil (i.e., 1.5 ml) are dropped on both the inner and, outer diameter surfaces of the boot seal 51 to initiate pre-operational employment swelling of the boot seals 51. Note, although polyalphaolefin is preferred, other preferably nonconductive dielectric products such as, for example, perfluorinated polyether can be utilized. Further, in the exemplary configuration, application of the polyalphaolefin is made to the surface only without application of pressure beyond normal surface environmental pressure. Also, any excess polyalphaolefin can be wiped off with an absorbent material.

After pre-impregnation with polyalphaolefin, boot seals 51 are quickly inserted prior to the boot seals 51 swelling beyond the internal diameter of the integral boot seal retaining/support rings 107, 109 to a point where the boot seals 51 cannot be easily inserted without substantial deformation. Where a thin layer of polyalphaolefin is applied to the outer surfaces, insertion will normally be required within a time of no more than approximately 10 minutes. Although the rate of swelling is generally not linear, the amount of swelling expected within approximately 10 minutes is equal to a increase in volume of approximately 0.5% or so with an eventual increase of approximately 1-2%. If swelling in excess of 0.5% or so occurs prior to insertion, the boot seals 51 should be discarded and a replacement set of boot seals 51 are again pre-impregnated with polyalphaolefin and inserted into upper insulator 55.

Alignment pin 111 (see, e.g., FIG. 2) is then inserted into alignment pin bore 113 in the upper insulator 55 and the lower insulator 53 is rotated to align a corresponding alignment pin bore 115 in the lower insulator 53 with the alignment pin 111. The lower insulator 53 is then inserted into cavity 33. At this point, boot seals 51 are firmly contained within cavity 60 extending across the lower and upper insulators 53, 55.

As shown in FIG. 4, within each cavity 60, the outer diameter of a medial portion of the boot seal 51 is in contact with the inner diameter of integral retaining/support rings 107, 109. As will be described in more detail below, as the boot seal 51 swells, it begins to fill the portion of the cavity 60 formed by recesses 101, 103, 105. Further depicted in the embodiment of FIG. 4, the conical portion 61 of lower insulator 53 and conical portion 75 of the upper insulator 55 contain the tapered portions of boot seals 51 to further enhance sealing of the boot seals 51 around the outer diameter of the insulation 41 or tubing 43 of conductors 39 as the boot seal 51 swells.

It should be noted that although swelling due to polyalphaolefin is not instantaneous, if there is a delay in inserting the pre-impregnated boot seals 51, e.g., of more than approximately 10 minutes, the boot seals 51 will likely need to be discarded as they may have swelled beyond their capacity to be properly inserted without potential damage.

In an example of assembly, the boot seals 51 are inserted and the lower insulator 53 is positioned in contact with upper insulator 55. The retaining nut 91 is threadingly connected to corresponding annular threads 92 within the cavity 33 of the housing 31 to retain the lower and upper insulators 53, 55, thereby encapsulating the boot seals 51 in the cavities 57, 59 of the insulators 53, 55. As illustrated in the example embodiment of FIG. 5, the encapsulated boot seals 51 continue to swell and expand into cavity 60 as a result of polyalphaolefin and motor oil impregnation and as a result of thermal expansion.

Referring again to FIG. 3, when the operator is ready to connect the pothead assembly 22 to the motor housing 24 (FIG. 1), a lead washer 121 is inserted around a retaining nut extension 123, a retaining nut boot seal 125 is inserted over the retaining nut extension 123, and the housing 31 is connected to the motor housing 24 using, for example, a pair of bolts (not shown) extended through a corresponding pair of bolt holes 127. Upon connection to the motor housing 24, boot seals 51 are then exposed to the oil (e.g., polyalphaolefin) from the motor 16. This will induce further pre-deployment swelling, typically in a range of approximately 10-20% within approximately 24 hours of connection.

Figure 5:
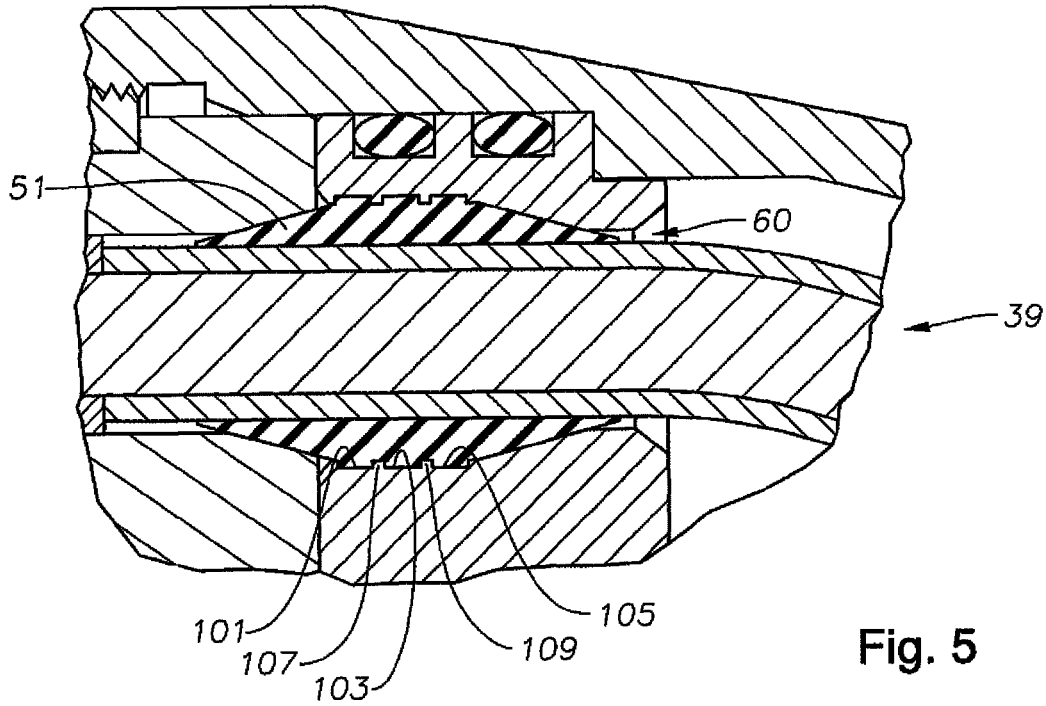
FIG. 5 is cross-sectional view of a pothead assembly after pre-impregnation with oil according to an embodiment of the present invention.

After the additional pre-swelling due to the motor oil is completed, the ESP 12 is then lowered down the wellbore 10 as in the example embodiment in FIG. 1, where the upper end of the boot seals 51 are exposed to well fluids including hydrocarbons, water, brine, and well treatment fluids and aromatics such as, for example, Xylene, Toluene, and Benzene. Once exposed to well fluids and typical temperatures of between 200-350° F., swelling of the boot seals 51 can be expected to be within the 30-40% range, which as shown in FIG. 5, is readily accommodated by cavity 60. Note, exposure to well fluids, particularly the aromatic fluids, can result in a swelling of between approximately 50-60%. This level of swelling, however, generally only occurs on a very small portion of the upper end of boot seals 51 adjacent a conically shaped well fluid inlet portion 113 of bore 59, that is in actual physical contact with the well fluids, and thus, does not result in excessive compression being applied to conductor 39.

Various embodiments of the present invention have several advantages. For example, various embodiments of the present invention account for boot seal contamination with oil which results in the boot seal 51 having a larger size than that of its manufactured size, by determining the expected size of the contaminated boot seal 51 and adjusting the size of the cavity 60 containing the boot seal 51 to account for such size increase. Further, various embodiments of the present invention ensure a proper pre-deployment seal between the pothead assembly 22 and ESP motor conductors 39 by pre-impregnating the boot seals 51 with oil. Further, various embodiments of the present invention extend the maximum operating temperature of the pothead assembly 22 by further sizing the cavity 60 to account for both motor oil contamination in conjunction with thermal expansion, while limiting the size of the cavity 60 and/or adjusting its shape to prevent leakage during cold operations.

This patent application is a non-provisional of and claims priority to and the benefit of U.S. Provisional Patent Application No. 61/405,875 filed on Oct. 22, 2010, incorporated by reference in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. An electrical submersible pump system (ESP) comprising:

a pump;

an electric motor operably coupled to the pump; and an apparatus for forming a seal around at least one conductor connected to the motor defining a pothead connector, the pothead connector comprising a housing having a pothead assembly cavity and a pothead assembly contained within the housing, the pothead assembly comprising;

a first insulator having a first bore extending therethrough having a generally cylindrical shaped portion and a generally conical shaped portion adjacent thereto;

a second insulator having a second bore extending therethrough and having a generally cylindrical portion and a generally conical shaped proximal portion adjacent thereto, the conical shaped portion of the second bore registering with the cylindrical shaped portion of the first bore to define a boot seal cavity; and a boot seal for receiving, a conductor positioned within the boot seal cavity, the boot seal comprising a substantially cylindrical shaped medial outer surface portion, a tapered proximal outer surface portion, a tapered distal outer surface portion, and a throughbore sized to sealingly engage inner surface portions of the hoot seal with outer surface portions of the conductor and to sealingly engage with inner surface portions of the first and the second insulators forming boot seal cavity.

2. An electrical submersible pump system as defined in claim 1, wherein the conical shaped portion of the first insulator comprises a generally conical shaped medial portion contained within the confines of the body of the first insulator, and wherein the first insulator further has a generally conical shaped proximal portion adjacent to the conical shaped medial portion and extending through a proximal face of the first insulator.

3. An ESP system as defined in claim 1, wherein the cylindrical shaped portion of the first insulator includes a plurality of integral annular hoot seal retaining and support rings extending into the first bore to provide sufficient support to the boot seal during low-temperature operations in which the boot seal has not expanded into a portion of a volume of the hoot seal cavity between adjacent rings of the plurality of annular rings.

4. An ESP system as defined in claim 1, wherein the hoot seal cavity includes a plurality of annular recesses each surrounding or interleaved with one or more of the plurality of annular boot seal retaining and support rings.

5. An ESP system as defined in claim 1, wherein a volume of the boot seal cavity between outer surface portions of the conductor an inner surfaces of the first and second bores defining the boot seal cavity is a fixed volume, and wherein the volume of the boot seal cavity exceeds at least approximately 20% of a pre-expansion volume of the boot seal contained within the boot seal cavity to provide for thermal and contaminant-based expansion of the boot seal.

6. An ESP system as defined in claim 1, wherein a volume of the boot seal cavity between outer surface portions of the conductor is substantially greater than a pre-expansion volume of the boot seal contained within the boot seal cavity to provide for thermal and contaminant expansion of the boot seal.

7. An ESP system as defined in claim 1, wherein an upper face of the second insulator registers with a lower face of the first insulator, and wherein substantial portions of the boot seal extend across the upper and lower faces to prevent fluid incursions between the faces.

8. New An ESP system as defined in claim 1, wherein the boot seal comprises a material that expands when contaminated with a dielectric oil.

9. An ESP system as defined in claim 1, wherein the boot seal is pre-impregnated with a dielectric of the boot seal being located within the boot seal cavity prior to substantially full expansion resulting from the pre-impregnation.

10. An ESP system as defined in claim 1, wherein the pothead connector has an operational temperature rating at or in excess of 425° F. without requiring utilization of boot seal cavity size adjustment or insulator separation systems.

11. An ESP system as defined in claim 1, wherein the boot seal is impregnated with a catalyst to pre-expand a volumetric size of the boot seal, the boot seal configured to sealingiy engage inner surface portions of the boot seal with outer surface portions of the conductor.

12. An ESP system as defined in claim 11, wherein the boot seal is configured for insertion into at least a portion of a boot seal cavity located within the first insulator before extensive volumetric expansion of the boot seal occurs:

wherein the boot seal is further configured for volumetric expansion within the boot seal cavity after insertion therein and wherein the boot seal cavity is sized to accommodate a post-expansion volume of the boot seal, the post-expansion volume substantially matching the volume of the boot seal cavity.

13. An ESP system as defined. in claim 11, wherein the catalyst is located on both inner and outer diameter surfaces of the boot seal to initiate pre-operational employment swelling of the boot seal.

14. An ESP system as defined in claim 1, wherein the boot seal is impregnated with a thin film of polyalphaolefin-based catalyst.

15. An ESP system as defined in claim 1, wherein the boot seal is impregnated with a thin film of perfluorinated polyether-based catalyst.

16. An ESP system as defined in claim 1, wherein the boot seal is impregnated with a total of approximately 1.5 mL. of catalyst spread across both inner and outer diameter surfaces of the boot seal to initiate pre-operational employment swelling of the boot seal.

17. An ESP system as defined in claim 1, wherein the boot seal is configured so that substantial volumetric expansion occurs within the hoot seal cavity after pre-deployment contamination with motor fluid of the motor and configured so that further substantial volumetric expansion occurs upon post-operational deployment contamination of the boot seal with well fluids and when exposed to environmental temperatures in a downhole operating environment.

18. An ESP system as defined in claim 1, wherein a desired volume of the boot seal cavity is defined by empirical data describing an amount of swelling or contraction to be expected from the boot seal due to dielectric, fluid pre-impregnation, motor oil contamination, well fluids contamination, and wellbore downhole temperatures according to expected downhole operating environment to be encountered by the ESP system.

* * * * *

UNITED STATES PATENT AND TRADEMARK OFFICE

CERTIFICATE OF CORRECTION

PATENT NO. : 8,512,074 B2
APPLICATION NO. : 13/247196
DATED : August 20, 2013
INVENTOR(S) : Jeffrey G. Frey It is certified that error appears in the above-identified patent and that said Letters Patent is hereby corrected as shown below:

In the Specification:

Column 3, line 27, delete “an” and insert -- and --

In the Claims:

Claim 5, Column 10, line 19, delete “an” and insert -- and --
Claim 8, Column 10, line 36, delete “New”
Claim 9, Column 10, line 40, delete “of the boot seal” and insert -- prior to --
Claim 9, Column 10, line 41, delete “prior”
Claim 12, Column 10, line 59, delete “therein” and insert -- therein; --

Signed and Sealed this
Seventeenth Day of December, 2013

Margaret A. Focarino

Margaret A. Focarino
*Commissioner for Patents of the United States Patent and Trademark Office*